US009216433B2

(12) United States Patent
Hasebe et al.

(10) Patent No.: US 9,216,433 B2
(45) Date of Patent: Dec. 22, 2015

(54) POWDER COATING SYSTEM

(71) Applicant: DENSO CORPORATION, Kariya-shi, Aichi (JP)

(72) Inventors: Yuta Hasebe, Obu (JP); Kazunori Mizutori, Toyohashi (JP); Kouji Kida, Tahara (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/384,459

(22) PCT Filed: Oct. 9, 2012

(86) PCT No.: PCT/JP2012/076132

§ 371 (c)(1),
(2) Date: Sep. 11, 2014

(87) PCT Pub. No.: WO2013/140647

PCT Pub. Date: Sep. 26, 2013

(65) Prior Publication Data

US 2015/0101531 A1 Apr. 16, 2015

(30) Foreign Application Priority Data

Mar. 21, 2012 (JP) ..... 2012-063563

(51) Int. Cl.
*B05C 13/02* (2006.01)
*B05B 15/12* (2006.01)
(Continued)

(52) U.S. Cl.
CPC ..... *B05B 15/1214* (2013.01); *B05B 13/0228* (2013.01); *B05B 15/04* (2013.01);
(Continued)

(58) Field of Classification Search
CPC ..... B05B 15/1214; B05B 15/1203; B05B 13/0242; B05B 5/14; B05C 13/00; B05C 11/08; Y10S 118/07; Y10S 55/46
See application file for complete search history.

(56) References Cited

U.S. PATENT DOCUMENTS 1,368,338 A * 2/1921 House, Jr. ..... B05B 13/028 118/320
2,781,279 A * 2/1957 Miller ..... B05B 5/14 118/323

(Continued)

FOREIGN PATENT DOCUMENTS

JP U-59-65757 5/1984
JP A-7-155652 6/1995

(Continued)

OTHER PUBLICATIONS

International Search Report issued in International Application No. PCT/JP2012/076132 mailed Dec. 4, 2012.

*Primary Examiner* — Karl Kurple
(74) *Attorney, Agent, or Firm* — Oliff PLC

(57) ABSTRACT

A powder coating system which is provided with a rotating stage which makes a metal cylindrical member rotate while holding its internal circumferential surface, a first booth which covers part of the metal cylindrical member which is held by the rotating stage, and a second booth which holds the first booth. A powder coating introduction nozzle which is provided with a filling port of powder coating and a plurality of powder coating spray ports is provided so that a filling port is positioned at the outside of the second booth and so that the plurality of spray ports can be changed in position in the first booth to face surface parts of the metal cylindrical member. The sprayed powder coating is collected inside the second booth by a flow of air from a blow device and is removed by being sucked up by a powder collector.

9 Claims, 9 Drawing Sheets

(51) Int. Cl.

| | |
|---|---|
| ***B05B 13/02*** | (2006.01) |
| ***B05B 15/04*** | (2006.01) |
| ***B05C 9/10*** | (2006.01) |
| *B05B 5/00* | (2006.01) |
| *B05B 5/08* | (2006.01) |
| *B05B 5/12* | (2006.01) |
| *B05B 7/14* | (2006.01) |
| *B05B 5/025* | (2006.01) |

(52) U.S. Cl.

CPC ..... *B05C 9/10* (2013.01); *B05B 5/001* (2013.01); *B05B 5/025* (2013.01); *B05B 5/08* (2013.01); *B05B 5/081* (2013.01); *B05B 5/082* (2013.01); *B05B 5/12* (2013.01); *B05B 7/1486* (2013.01); *Y10S 55/46* (2013.01); *Y10S 118/07* (2013.01)

(56) References Cited

U.S. PATENT DOCUMENTS 3,731,340 A 5/1973 Pitre, Sr.
3,913,523 A * 10/1975 Probst ..... B05B 5/032 118/626
4,244,318 A * 1/1981 Chen ..... B06C 5/00 118/52
4,386,578 A * 6/1983 Haslund ..... B05B 7/22 118/50.1
4,567,818 A * 2/1986 Napadow ..... B05B 15/1277 118/326
4,787,330 A * 11/1988 Bolf ..... B05B 5/08 118/308
5,079,043 A * 1/1992 Lambert ..... B05B 13/0228 427/425
5,288,324 A * 2/1994 Shaneyfelt ..... B05B 15/1214 118/326
2004/0200418 A1* 10/2004 Hartig ..... C23C 4/12 118/723 MP
2009/0255467 A1* 10/2009 Britt ..... C23C 14/024 118/718
2012/0304924 A1* 12/2012 Fernholz ..... B05B 13/0221 118/500
2015/0017897 A1* 1/2015 Wiliams ..... B05B 15/1296 454/51
2015/0211749 A1* 7/2015 Robison ..... F24C 15/2021 454/340

FOREIGN PATENT DOCUMENTS

JP A-9-10638 1/1997
JP A-2001-276688 10/2001
JP A-2005-13931 1/2005
JP B2-4074708 4/2008

* cited by examiner

POWDER COATING SYSTEM

TECHNICAL FIELD

The present invention relates to a powder coating system which uses a powder coating to coat a coatable material in a coating space.

BACKGROUND ART

As a coating method which forms a coating film of a thin uniform thickness on a surface part of a coatable material, the electrostatic powder coating method is known. As one example of such an electrostatic powder coating method, the method of coating a metal cylindrical member which uses a resin powder as a powder coating such as in PLT 1 is known. In electrostatic powder coating, first, the resin powder is charged by application of static electricity. Next, a coatable object charged with static electricity of the opposite polarity is coated with the charged resin powder to make the powder deposit on the surface of the coatable object. Finally, the coatable object is heated to make the resin powder which is deposited on the coatable object melt and form a coating film on the surface of the coatable object to thereby complete the electrostatic powder coating process. The resin powder will hereinafter be referred to as "powder coating".

The powder coating art up to now has suspended the coatable material in a coating booth larger than the coatable material to make it the ground potential, mixed the powder coating with a flow of air for transport, charged the powder coating with static electricity at the spray port of a coating gun, and sprayed the powder coating on the suspended coatable material to coat it. For this reason, the volume in which the powder coating scattered was large at the time of coating the powder coating, so the coating booth became large in size. Further, since the coating booth was large in size, the required capacity and size of the powder collector for collecting and recovering the powder coating after coating also became large. As a result, even if the coatable material were small in size, a large sized coating booth and powder collector were required for powder coating. It was difficult to reduce the size and streamline the powder coating facilities.

Furthermore, in powder coating, the ratio of the powder coating which is deposited on the coatable material in a coating booth is about 30%. The remaining powder coating is recovered for reuse, but after several times of use, the powder coating degrades and has to be replaced. The final utilization rate was about 90%. Therefore, it has been desired to raise the rate of deposition of the powder coating on the coatable material in the coating booth and improve the final utilization rate of powder coating.

On the other hand, the inventors noted that among metal cylindrical members which are powder coated, there are ones which do not require coating at their internal circumferential surfaces and discovered that for this type of metal cylindrical member, it is possible to improve the structure of the coating booth of the powder coating system to reduce the size and possible to improve the final utilization rate of the powder coating.

CITATIONS LIST

Patent Literature

PLT 1: Japanese Patent No. 4074708

SUMMARY OF INVENTION

Technical Problem

The present invention, in consideration of the above problem, provides a powder coating system which can raise the rate of deposition of a powder coating on a coatable material in a coating booth and which can raise the final utilization rate of a powder coating for the above types of metal cylindrical members.

Solution to Problem

To solve this problem, the powder coating system (5) of the present invention is provided with a rotating stage (3) which makes a metal cylindrical member (1) rotate while holding its internal circumferential surface (2), a first booth (10) which covers part of the metal cylindrical member (1) which is held by the rotating stage (3) in a state where the metal cylindrical member (1) can rotate, a second booth (20) which holds the first booth (10) separated by a predetermined internal space (21), and a powder coating introduction nozzle (30) which is provided with a single powder coating filling port (31) and a plurality of powder coating spray ports (32), wherein the filling port (31) is positioned at an outside of the second booth (20), and the plurality of spray ports (32) are provided with which can be freely changed in position in the first booth (10) to face the surface part of the metal cylindrical member (1).

Due to this, it becomes possible to improve the rate of deposition of the powder coating on the coatable material in the coating booth and improve the final utilization rate of the powder coating for types of metal cylindrical members not requiring coating of the internal circumferential surface.

Note that, the above parenthesized reference numerals show examples which show the correspondence with specific embodiments which are described the later explained aspects.

DESCRIPTION OF EMBODIMENTS

Figure 1A:
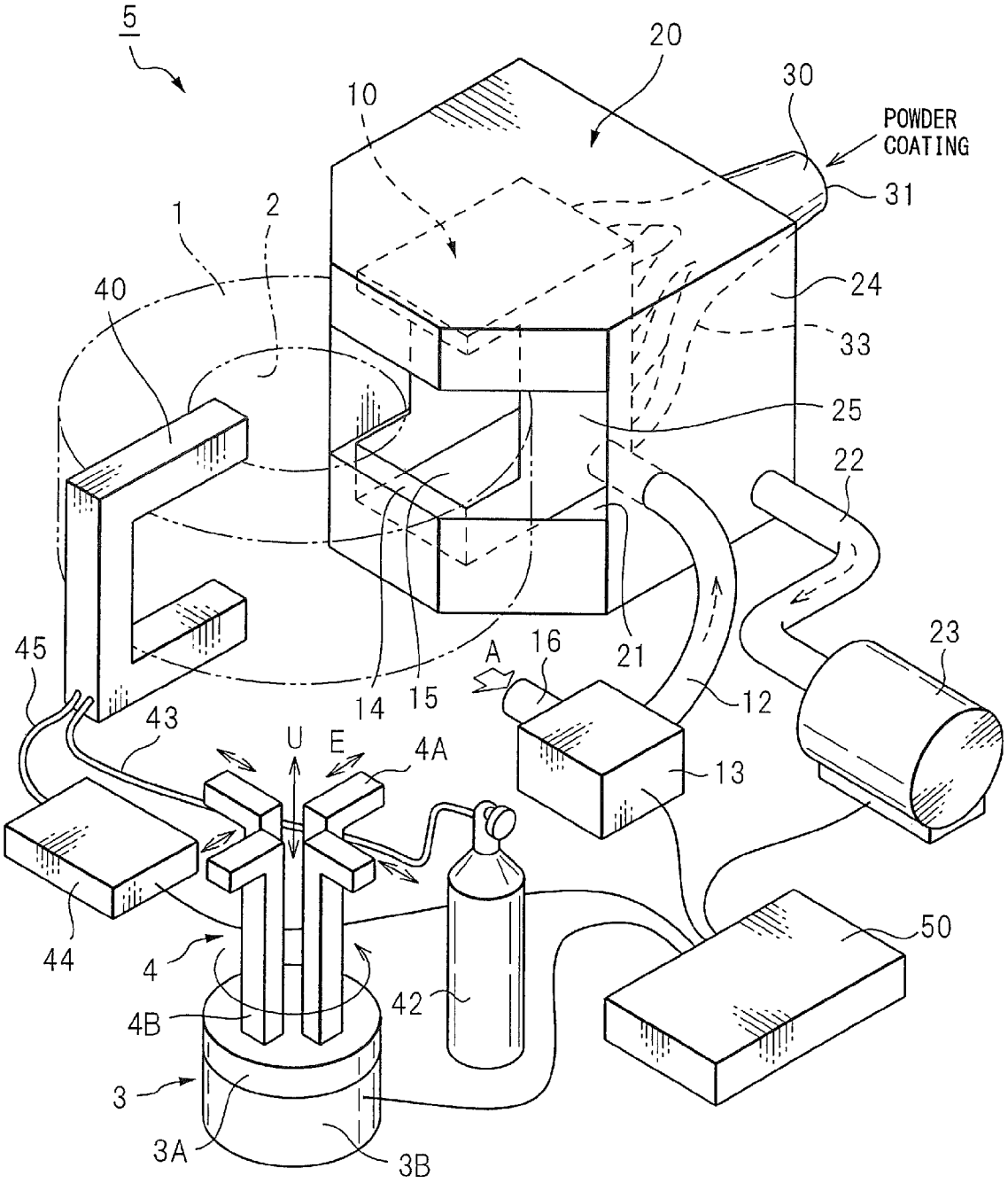
FIG. 1A is a perspective view which shows an example of the arrangement of members of a powder coating system of a first aspect of the present invention.

Below, referring to the drawings, aspects of the present invention will be explained. In the embodiments, the same parts of the configurations are assigned the same reference numerals and explanations will be omitted. Further, in the present invention, as a coatable material, a metal cylindrical member will be explained as an example.

FIG. 1A is a perspective view which shows an example of the arrangement of the different members of a powder coating system 5 of a first aspect of the present invention. The powder coating system 5 of the first aspect can be provided with a rotating stage 3, first booth 10, second booth 20, powder coating introduction nozzle 30, plasma treatment device 40, and control device 50. The powder coating system 5 coats a metal cylindrical member 1 which is set at the position which is shown by the two-dot chain line by a powder coating.

The powder coating system 5 of the present invention is one which is used for coating a metal cylindrical member 1 which is shown by a two-dot chain line. This metal cylindrical member 1 does not have to be coated at the internal circumferential surface 2. Therefore, the metal cylindrical member 1 is held at its internal circumferential surface 2, which is not to be coated, by a chuck member 4 which is provided at the rotating stage 3. The rotating stage 3 is provided with a rotating part 3A to which the chuck member 4 is attached and a drive part 3B which makes the rotating part 3A rotate. The rotating part 3A can be rotated by the drive part 3B at 5 to 1000 rpm. Further, the rotating stage 3 can be moved up and down by a not shown elevator device in the direction shown by the arrow U and can raise the metal cylindrical member 1 to the position of the opening part 25 of the second booth 20.

Figure 1B:
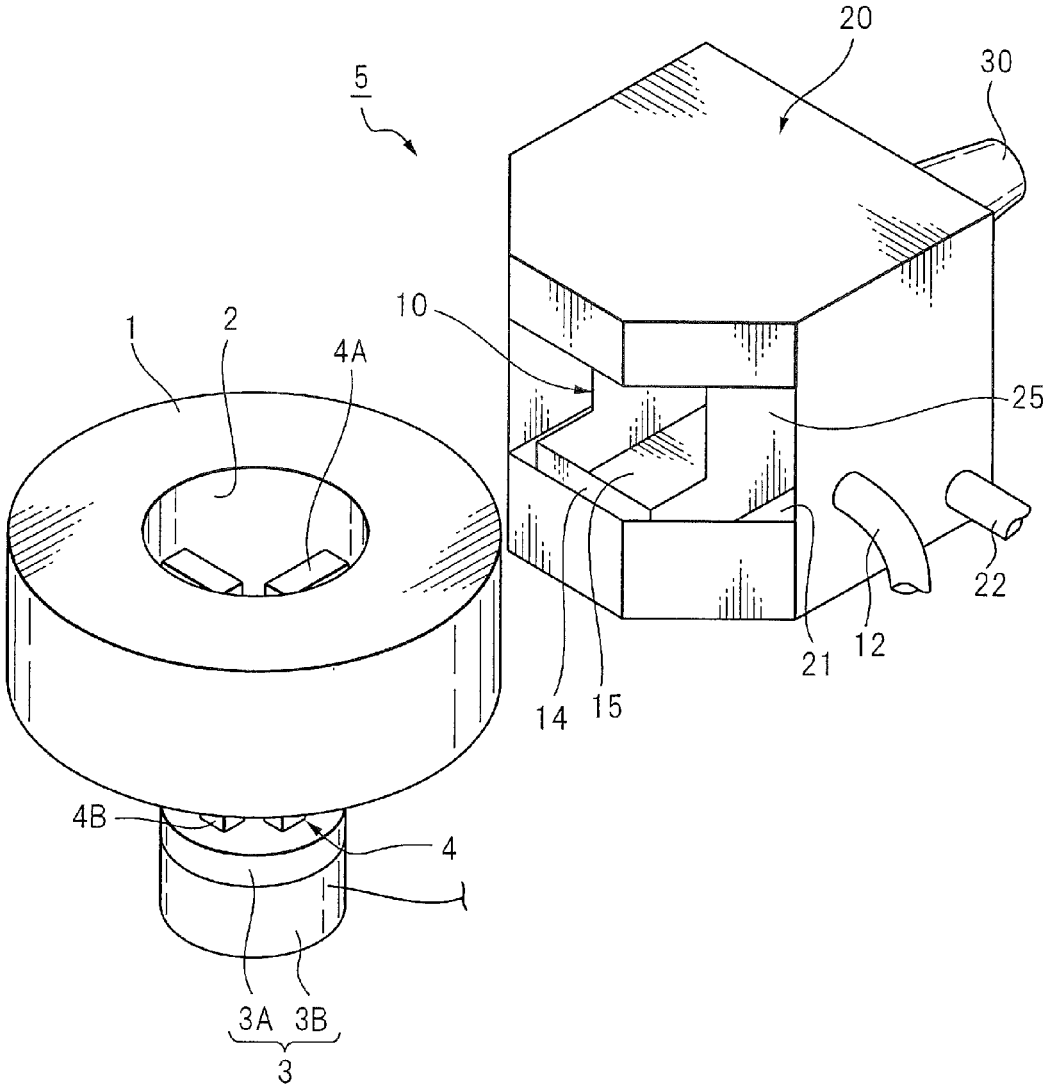
FIG. 1B is a perspective view which shows the state of a rotating stage which is shown in FIG. 1A holding a metal cylindrical member to be coated by powder by a chuck member.

The chuck member 4 is provided with a plurality of rod parts 4B and arm parts 4*a* which are provided at the front end parts of the rod parts 4B. The base parts of the rod parts 4B are provided sticking out from the rotating part 3A. In this example, there are four rod parts 4B, but the number of rod parts 4B is not limited to four. Any number is possible so long as a number whereby the arm parts 4A can reliably hold the internal circumferential surface 2 of the metal cylindrical member 1. The arm parts 4A are attached to the rod parts 4B in directions perpendicular to the same. The front end faces of the arm parts 4A face the internal circumferential surface 2 of the metal cylindrical member 1. Further, the arm parts 4A and extend and contract in the directions of the internal circumferential surface 2 of the metal cylindrical member 1 which are shown by the arrows E and thereby can hold the internal circumferential surface 2 of the metal cylindrical member 1 or release the hold. For the extension/contraction mechanism of the arm parts 4A, a known one can be used, so the explanation will be omitted here. FIG. 1B shows the state where internal circumferential surface 2 of the metal cylindrical member 1 is held by the chuck member 4 which is provided at the rotating stage 3. FIG. 1B shows only the metal cylindrical member 1 and the rotating stage 3, second booth 20, and powder coating introduction nozzle 30. Illustration of the other members is omitted.

Figure 1C:
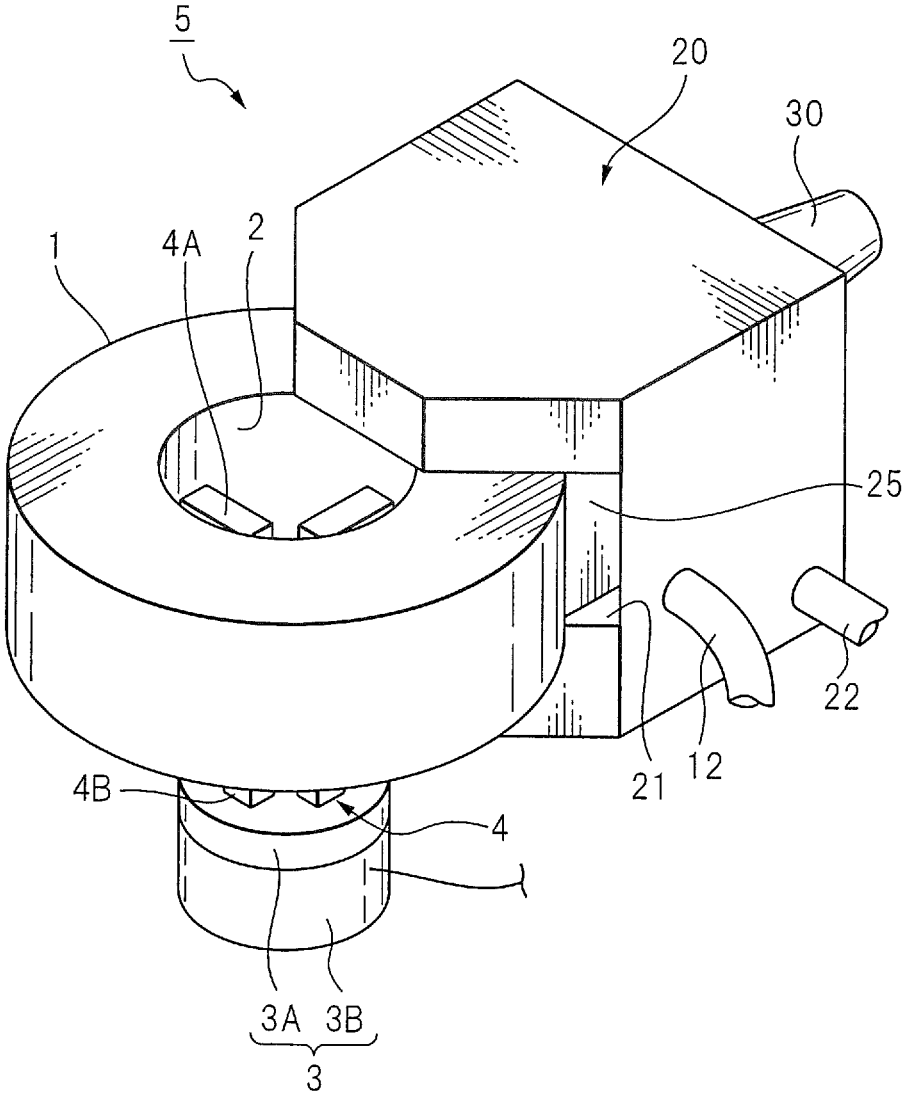
FIG. 1C is a perspective view which shows the state of part of the metal cylindrical member which is held by the rotating stage which is shown in FIG. 1B inserted in a second booth of the powder coating system.

The first booth 10 is a size of an extent which covers part of the metal cylindrical member 1 which is held on the rotating stage 3, while the second booth 20 is a size which can hold the first booth 10 separated by a predetermined internal space 21. At the housing 14 of the first booth 10 at the side facing the metal cylindrical member 1, there is an opening part 15. Part of the metal cylindrical member 1 is inserted in this opening part 15. Further, at the housing 24 of the second booth 20, there is an opening part 25 at a position which overlaps the opening part 15 of the first booth 10. Part of the metal cylindrical member 1 is also inserted into this opening part 25. The metal cylindrical member 1 can rotate in the state inserted into the opening parts 15 and 25. The second booth 20 is a shape narrowed in width at the metal cylindrical member 1 side, but the shape is not particularly limited. FIG. 1C shows the state where part of the metal cylindrical member 1 which is held by the chuck member 4 of the rotating stage 3 is inserted in the opening part 25. FIG. 10 shows only the metal cylindrical member 1 and the rotating stage 3, second booth 20, and powder coating introduction nozzle 30. Illustration of the other members is omitted.

The powder coating introduction nozzle 30 is provided with a single filling port 31 of a powder coating which is positioned at the outside of the second booth 20. The powder coating introduction nozzle 30 is branched into a plurality of runners 33 at the inside of the second booth 20. The plurality of runners 33 are inserted into the first booth 10. The shape of the first booth 10 at the front ends of the plurality of runners 33 and the spray ports at the front ends of the plurality of runners 33 will be explained later. The powder coating which is filled from the powder coating filling port 31 of the powder coating introduction nozzle 30 can be filled using a later mentioned coating gun.

At the first booth 10, a blow device 13 which is provided with a pipe 12 which can charged the booth with a flow of air is connected to a side surface of the housing 14. Further, at the second booth 20, a powder collector 23 which is provided with a hose 22 which sucks in the powder coating which remains inside is connected. The powder collector 23 can store the sucked in and recovered powder coating at the inside. When the powder coating introduction nozzle 30 sprays the powder coating inside the first booth 10, the blow device 13 does not operate. The blow device 13 operates after coating is finished whereby air which is sucked in from the suction port 16 is filled inside the first booth 10. If the blow device 13 fills air inside the first booth 10, the powder coating which has collected in the first booth 10 is pushed out to the internal space 21 of the second booth 20 and is sucked up by the powder collector 23.

Figure 1D:
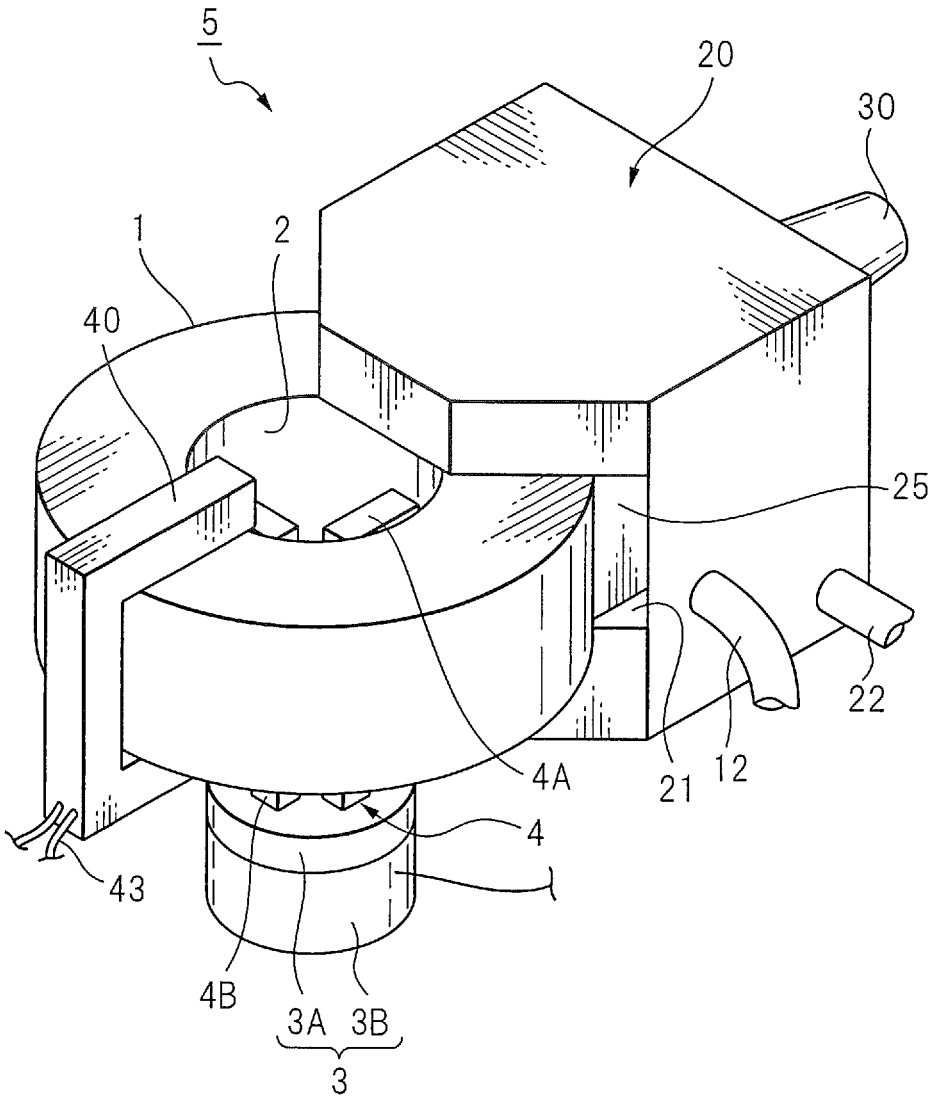
FIG. 1D is a perspective view which shows the state of a plasma treatment device attached to a metal cylindrical member which is set in the powder coating system which is shown in FIG. 10.

The plasma treatment device 40 is provided at the metal cylindrical member 1 which is held at the rotating stage 3 where it does not interfere with the second booth 20. The internal configuration of the plasma treatment device 40 will be explained later, but the plasma treatment device 40 is connected through the pipe 43 to a plasma gas supply source 42 and is connected by a cord 45 to a plasma power source 44. The plasma treatment device 40 uses plasma to treat the metal cylindrical member 1 and improves the force of adhesion of the powder coating to the surface of the metal cylindrical member 1. Sometimes the powder coating system 5 is provided with the plasma treatment device 40 and sometimes it is not. FIG. 1C shows the case where the powder coating system 5 is not provided with the plasma treatment device 40, while FIG. 1D shows the case where the powder coating system 5 is provided with the plasma treatment device 40. FIG. 1D shows only the metal cylindrical member 1 and the rotating stage 3, second booth 20, powder coating introduction nozzle 30, and plasma treatment device 40. Illustration of the other members is omitted.

The blow device 13, powder collector 23, and plasma power source 44 have a control device 50 which controls their operation connected to them. The control device 50 further controls rotation of the rotating stage 3, controls charging of air into the first booth 10 by the blow device, and controls suction by the powder collector 23. The control by the control device 50 will be explained later.

Figure 2:
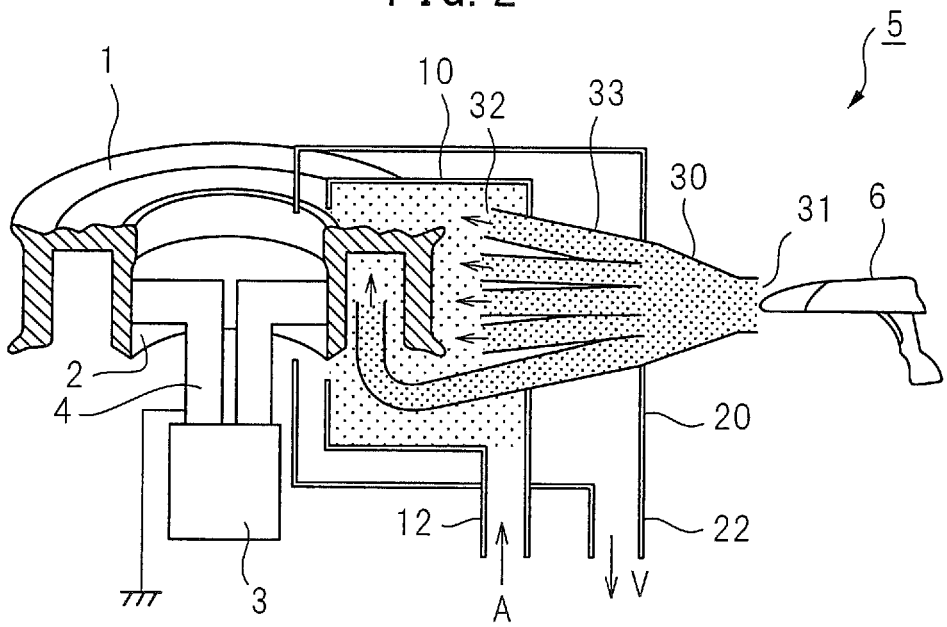
FIG. 2 is a cross-sectional view which shows a first embodiment of a powder coating system of the first aspect of the present invention.

FIG. 2 is a cross-sectional view which shows a first embodiment of a powder coating system 5 of the present invention. The powder coating system 5 of the first embodiment is not provided with the plasma treatment device. In the powder coating system 5 of the first embodiment, the rotating stage 3 has a coatable material constituted by a metal cylindrical member 1 placed on it. When attaching the metal cylindrical member 1 to the rotating stage 3, first, the rotating stage 3 is lowered, then in that state the metal cylindrical member 1 is inserted into the first booth 10. In this state, the rotating stage 3 is made to rise and the chuck member 4 is inserted to the inside of the internal circumferential surface 2 of the metal cylindrical member 1. In this state, the chuck member 4 is closed. When the chuck member 4 reaches a predetermined position at the inside of the internal circumferential surface 2 of the metal cylindrical member 1, the chuck member 4 is opened whereby the internal circumferential surface 2 of the metal cylindrical member 1 is held by the chuck member 4. The chuck member 4 is made of a conductive metal and is grounded to the ground potential. The powder coating system 5 which is shown in FIG. 1C corresponds to an aspect of the first embodiment.

When inserting the metal cylindrical member 1 inside the first booth 10, the runners 33 of the powder coating introduction nozzle 30 are retracted so as not to interfere with the metal cylindrical member 1. When the metal cylindrical member 1 is held by the chuck member 4 of the rotating stage 3, the spray ports 32 of the runners 33 are positioned facing the coating positions. For this reason, the runners 33 of the powder coating introduction nozzle 30 can be deformed. They are made of a flexible material by which positions of the spray ports 32 in the first booth 10 can be freely changed and the positions can be held. Note that, the portions of the runners 33 which are positioned in the second booth 20 do not particularly have to be deformed, so these parts do not have to be formed by a flexible material.

Further, the first booth 10 and the second booth 20 can be opened and closed when inserting the metal cylindrical member 1 inside of the first booth 10 and the second booth 20. Furthermore, when making the chuck member 4 hold the metal cylindrical member 1, it is also possible to separate the first and the second booths 10 and 20 from the metal cylindrical member 1, make the chuck member 4 hold the metal cylindrical member 1, then make the first and the second booth 10 move to insert the metal cylindrical member 1 into them.

If the metal cylindrical member 1 is held at the rotating stage 3 and inserted into the second booth 20, the control device 50 which is shown in FIG. 1A (illustration omitted in FIG. 2) is used to start the operation of the powder collector 23 whereby air inside of the second booth 20 is sucked out through the hole 22 as shown by the arrow V. Next, the rotating stage 3 rotates and powder coating is discharged from the coating gun 6 to the inside of the filling port 31. The powder coating passes through the runners 33 and is sprayed from the spray ports 32 toward the surface of the metal cylindrical member 1. Here, the larger the number of the runners 33 of the powder coating introduction nozzle 30, the finer the ratio of distribution of the coating to the coating portions can be controlled, but the runners 33 become positioned closer and arrangement becomes difficult. From this, to secure control of the distribution of supply and facilitate arrangement of the spray ports 32, the number of runners 33 should be between 10 to 30.

The powder coating which is sprayed from the spray ports 32 of the powder coating introduction nozzle 30 toward the metal cylindrical member 1 directly deposits in predetermined amounts at the surface of the metal cylindrical member 1. The powder coating which failed to be deposited collects inside the first booth 10 for a certain time. Therefore, the first booth 10 is also called the powder coating collecting booth. Further, the powder coating which collects inside the first booth 10 is charged, so is attracted to the coatable material by the electrostatic attraction while being collected and deposits on the surface of the metal cylindrical member 1. Therefore, the rate of deposition of the powder coating which is sprayed from the spray ports 32 of the powder coating introduction nozzle 30 toward the metal cylindrical member 1 on the surface of the metal cylindrical member 1 is improved.

At this time, the blow device 13 is not operating and air is not filled into the first booth 10 from the outside. In this way, if providing the first booth 10 at the inside of the second booth 20 to make a double-booth structure and coating while allowing the powder coating to collect inside the first booth 10, the ratio of powder coating which deposits on the surface of the metal cylindrical member 1 increases compared with the case of a single booth structure. As a result, the amount of powder coating which is recycled is reduced, the amount of degraded powder coating is reduced, and the rate of utilization of the powder coating is improved. As a result of experiments, the rate of utilization of the powder coating was improved from 90% to 95%.

On the other hand, the powder coating which failed to deposit on the surface of the metal cylindrical member 1 inside the first booth 10 and leaked out into the second booth 20 after collecting in the first booth 10 is sucked up by the powder collector 23. Due to this configuration, it is possible to keep the powder coating from scattering to the outside of the first and the second booths 10 and 20 and collect the powder coating at the inside of the powder collector 23. Further, compared with a general powder coating booth, the volume of the second booth 20 can be reduced to 1/100 or so, but the suction ability and treatment ability can be kept the same as those of conventional powder collectors. For this reason, the powder collector 23 of the present invention can be reduced in size to about 1/100 of a conventional powder collector without changing the suction ability and treatment ability.

If the metal cylindrical member 1 finishes being coated, the coating device 50 which is shown in FIG. 1A is used to stop the discharge of powder coating from the coating gun 6. Next, the control device 50 is used to separate the first and the second booths 10 and 20 from the metal cylindrical member 1 (this state corresponds to FIG. 1B). If the first and the second booths 10 and 20 are separated from the metal cylindrical member 1, the metal cylindrical member 1 can be detached from the rotating stage 3. The detached metal cylindrical member 1 is transported to the heat treatment process for baking the coating film.

After the metal cylindrical member 1 is taken out, the control device 50 is used to run air through the pipe 12 to the first booth 10 as shown by the arrow A and blow air in the first booth 10. Due to this air blow, the powder coating which remains in the first booth 10 is blown out to the second booth 20 side and the powder coating in the first booth 10 is removed. At this time, the powder coating which is blown out from the first booth 10 by the air blow moves to the second booth 20, then is recovered by the powder collector 23 shown in FIG. 1A. For this reason, the second booth 20 is also called a "powder collecting booth".

Figure 3:
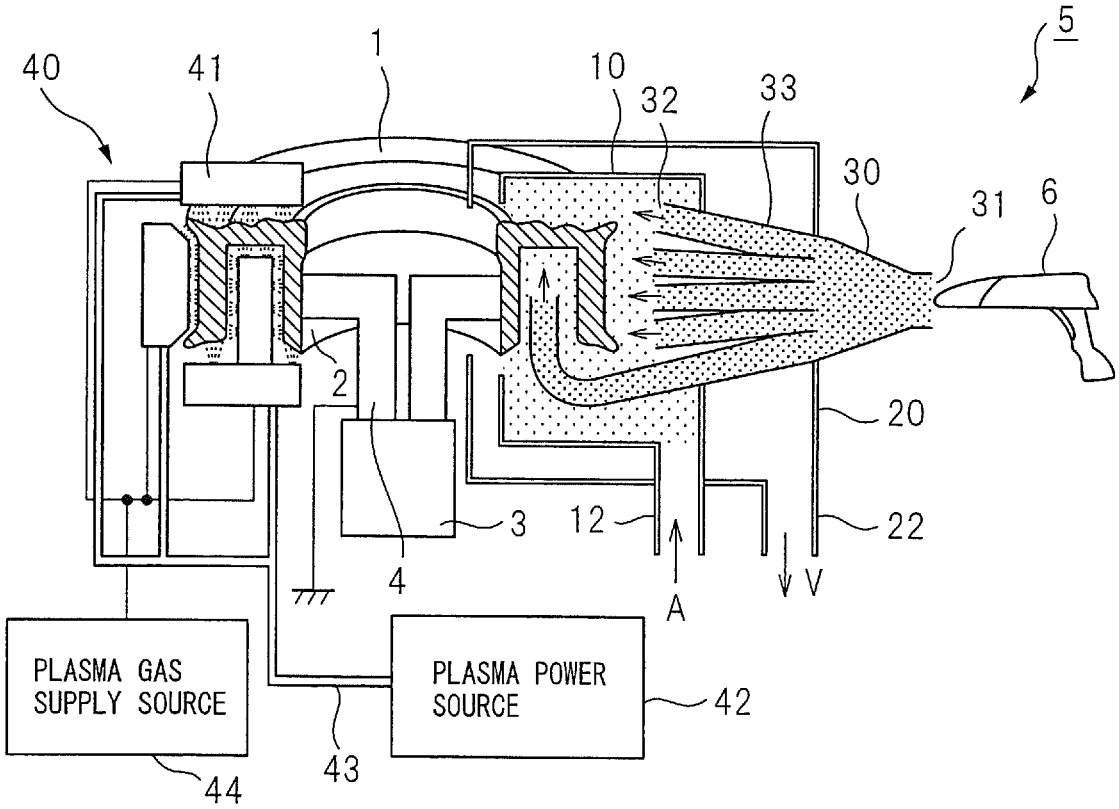
FIG. 3 is a cross-sectional view which shows a second embodiment of a powder coating system of the first aspect of the present invention.

FIG. 3 is a cross-sectional view which shows a second embodiment of the powder coating system 5 of the present invention. The powder coating system 5 of the second embodiment is provided with the plasma treatment device 40. The operation of the parts other than the plasma treatment device 40 in the second embodiment is the same as in the first embodiment, so component members the same as the first embodiment are assigned the same reference numerals and explanations of their operation will be omitted. The powder coating system 5 which is shown in FIG. 1D corresponds to the state of the second embodiment.

In the second embodiment, the plasma treatment device 40 is provided centered about the rotating stage 3 at a position at the opposite side to the first and the second booths 10 and 20. The plasma treatment device 40 is provided with a plurality of plasma treatment nozzles 41 matching the shape of the metal cylindrical member 1. The plasma treatment nozzles 41 are supplied with AC power from the plasma power source 44. Plasma gas is supplied from the plasma gas supply source 42 through the pipe 43. The plasma gas is a mixture of Ar, $O_2$, $H_2$, $N_2$ and air.

In the second embodiment, the rotating stage 3 holds the metal cylindrical member 1. The control device 50 which is shown in FIG. 1A (not illustrated in FIG. 3) is used to make the rotating stage 3 rotate, then the plasma treatment device 40 operates. At the time of operation of the plasma treatment device 40, plasma gas is supplied from the plasma gas supply source 42 through the pipe 43. In this state, the plasma power source 44 is turned on and the atmospheric pressure plasma air flow is ejected from the plasma treatment nozzle 41 to the surface of the metal cylindrical member 1. If the plasma treatment device 40 is operated and the metal cylindrical member 1 is treated with plasma for a predetermined time, the control device 50 is used to turn the plasma power source 44 off, the supply of plasma gas from the plasma gas supply source 42 is stopped, and the treatment of plasma from the plasma treatment nozzle 41 is stopped.

After this, the control device 50 is used to start the operation of the powder collector 23 and air inside of the second booth 20 is sucked through the hose 22 as shown by the arrow V. Next, in the state with the rotating stage 3 continuing to rotate, the coating gun 6 starts to discharge the powder coating. After this, in the same way as the first embodiment, the surface of the metal cylindrical member 1 starts to be coated using a powder coating. In this way, in the second embodiment, before coating powder on the surface of the metal cylindrical member 1, as pretreatment for coating, plasma is used to treat the metal cylindrical member 1.

Further, it is possible to use plasma to treat the metal cylindrical member 1, then successively coat the metal cylindrical member 1 with powder without transporting the metal cylindrical member 1. In general, it is known that if performing plasma treatment at atmospheric pressure, the atomic state of the irradiated surface is converted to polarized functional groups "—OH" and becomes an easily chemically reactable state. Due to this, the adhesive force is improved by the strong bond with the epoxy binder ingredient of the coated powder coating. However, even if performing this atmospheric pressure plasma treatment, the atomic state of the surface of the treated surface ends up returning to its original state along with the elapse of time. In the present invention, right after plasma is used to treat the metal cylindrical member 1, powder is coated on the surface of the metal cylindrical member 1, so the adhesive force of the powder coating on the surface of the metal cylindrical member 1 can be improved.

As opposed to this, in a conventional powder coating system, the plasma is used to treat the metal cylindrical member 1 at a separate location from the powder coating system. After plasma treatment, the metal cylindrical member 1 is conveyed to the powder coating system where it is coated with powder. Accordingly, even if placing the plasma treatment device near the powder coating system, at least tens of seconds of time is required as an estimate from when treating the surface by plasma to when coating powder and the effect of plasma treatment on the metal cylindrical member 1 ends up becoming weaker. As the result of experiments, it was learned that the powder coating system of the present invention can improve the deposition force of the powder coating on the surface of the metal cylindrical member 1 by about 20% compared with the conventional powder coating system close to the plasma treatment device.

Figure 4:
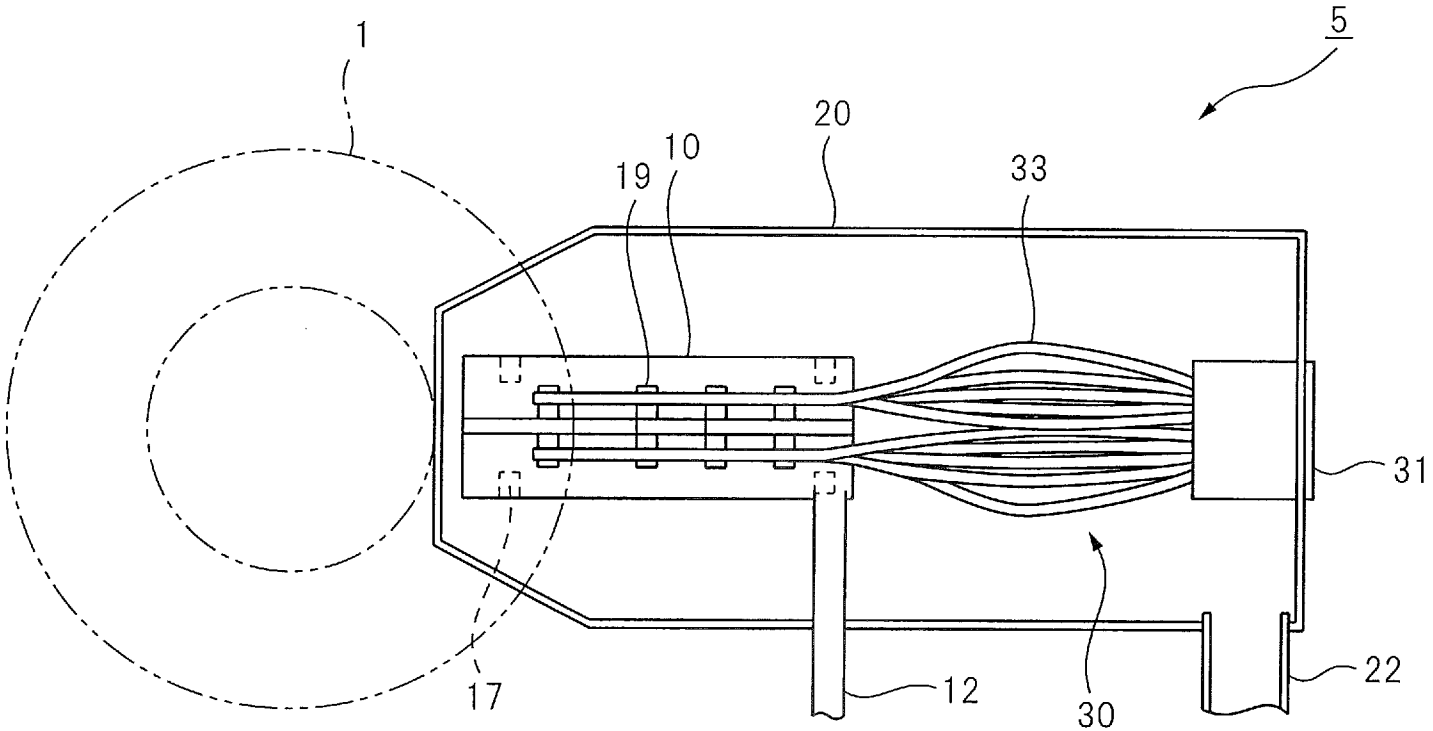
FIG. 4 is a cross-sectional view of a horizontal direction of a specific example of a powder coating system of the first aspect of the present invention.
Figure 5:
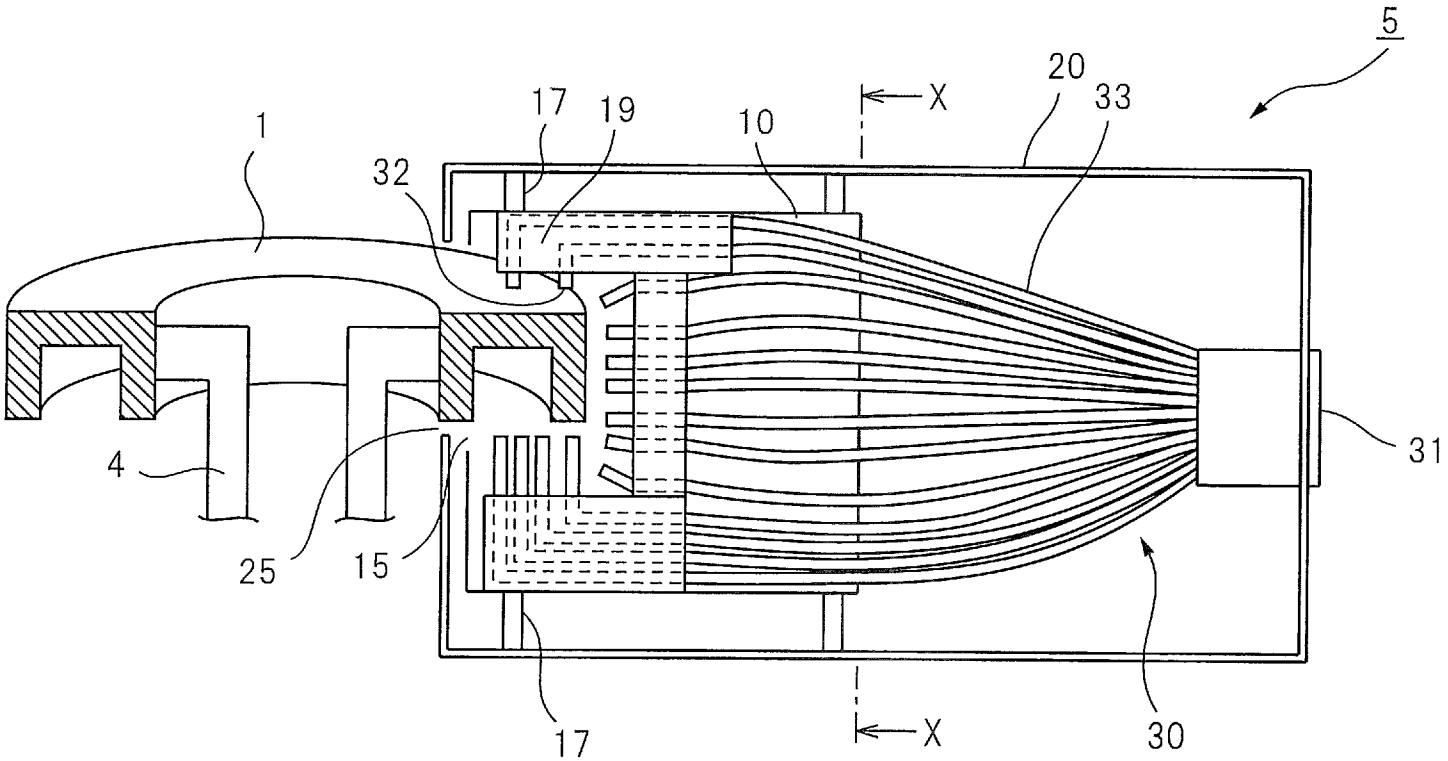
FIG. 5 is a cross-sectional view of a vertical direction of a specific example of a powder coating system which is shown in FIG. 4.
Figure 6:
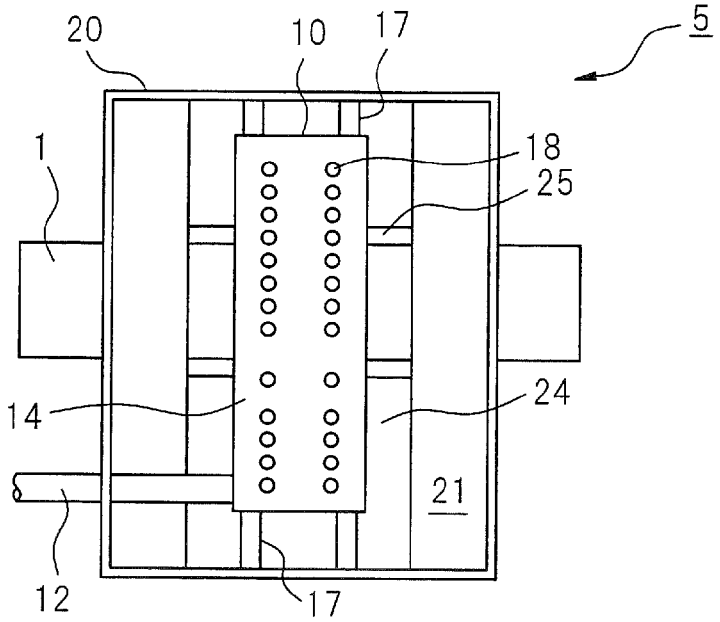
FIG. 6 is a cross-sectional view along a line X-X of FIG. 5.

Next, FIG. 4 to FIG. 6 will be used to explain the configuration of a specific example of the powder coating system 5 of the present invention. FIG. 4 is a cross-sectional view in the horizontal direction of a powder coating system 5 of the present invention, FIG. 5 is a cross-sectional view in the vertical direction of a powder coating system 5 which is shown in FIG. 4, and FIG. 6 is a cross-sectional view along the line X-X of FIG. 5. In a specific example of the powder coating system 5, component members the same as the embodiment of the present invention which was explained using FIG. 1 to FIG. 3 are assigned the same reference numerals for the explanation.

First, as shown in FIG. 5 and FIG. 6, the first booth 10 is fastened inside the second booth 20 by four supports 17. Further, as shown in FIG. 6, at the back surface of the housing 14 of the first booth 10, through holes 18 are provided for passing runners 33 of the powder coating introduction nozzle 30. The runners 33 are passed through the through holes 18 and enter the first booth 10. In this specific example, two rows of 13 each through holes 18 are provided in the vertical direction. There are a total of 26 through holes 18. Further, it will be understood that the height of the opening part 25 which is formed in the housing 24 of the second booth 20 is greater than the height of the metal cylindrical member 1 and that the metal cylindrical member 1 can rotate without in the opening part 25 without touching the housing 24.

Furthermore, the distance in the height direction between the metal cylindrical member 1 and the opening part 25 (clearance) when part of the metal cylindrical member 1 was inserted into the opening part 25 formed in the housing 24 of the second booth 20 was made 2 mm to 20 mm. This is because if the distance in the height direction between the metal cylindrical member 1 and the opening part 25 is smaller than 2 mm, the powder coating which has deposited at the surface of the metal cylindrical member 1 in the first booth 10 ends up being sucked up at the second booth 20 side. Further, this is because if the distance in the height direction between the metal cylindrical member 1 and the opening part 25 is larger than 20 mm, the powder coating which was sprayed at the first booth 10 will pass through the second booth 20 and scatter to the surroundings of the powder coating system 5.

Furthermore, as shown in FIG. 4, inside the first booth 10, there are a plurality of plastic stays 19 for fastening the runners 33 of the powder coating introduction nozzle 30. The runners 33 can be positioned by the stays 19 so that the spray ports 32 of the front ends are matched with the positions desired to be coated at the surface of the metal cylindrical member 1 as shown in FIG. 5. As the stays 19, it is possible to use blocks formed with holes and insert the runners 33 through the holes of the blocks to fasten them.

Figure 7A:
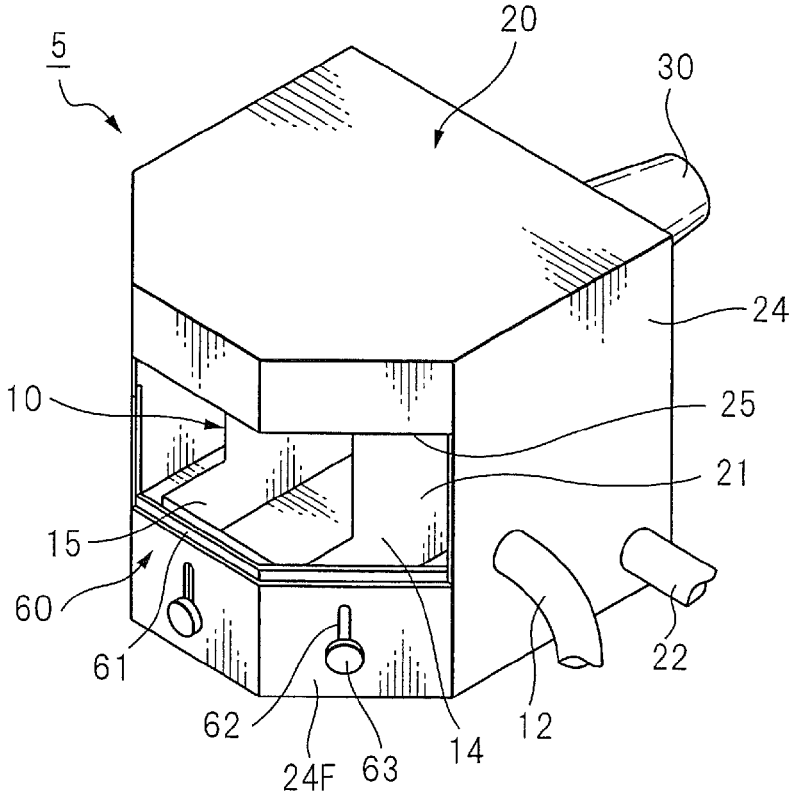
FIG. 7A is a perspective view which shows an example of a second booth housing a first booth of a powder coating system of a second aspect of the present invention.

FIG. 7A shows the configuration of the second booth 20 which is provided with the powder coating introduction nozzle 30 and holds the first booth 10 of the powder coating system 5 of the second aspect of the present invention. Around the second booth 20, it is possible to arrange the rotating stage 3, blow device 13, powder collector 23, plasma treatment device 40, plasma gas supply source 42, plasma power source 44, and control device 50 the same as the powder coating system 5 of the first aspect which is shown in FIG. 1A. The powder coating system 5 of the second aspect of the present invention differs from the powder coating system 5 of the first aspect in the point of being provided with a structure which enables coating while preventing scattering of the powder coating to the outside of the second booth 20 even if the metal cylindrical member 1 changes in height.

For this reason, in the powder coating system 5 of the second aspect of the present invention, at the inside of the opening part 25 of the second booth 20, an opening part height adjustment mechanism 60 which can change the height of the opening part 25 is provided. The opening part height adjustment mechanism 60 is provided with a slide plate 61, guide grooves 62, and operating knobs 63. The slide plate 61 moves up and down along the inside of the front housing part 24F which is positioned below the opening part 25 of the second booth 20 so as to change the height of the opening part 25. Normally, it is hidden at the back side of the front housing part 24F. The guide grooves 62 determine the distance of movement of the slide plate 25 in the up and down directions and are provided at all of the three faces of the front housing part 24F. The operating knobs 63 are attached to the slide plate 61 by their shafts being passed through the guide grooves 62. By making these move up and down from the outside, the slide plate 61 moves in the up and down direction.

Figure 7B:
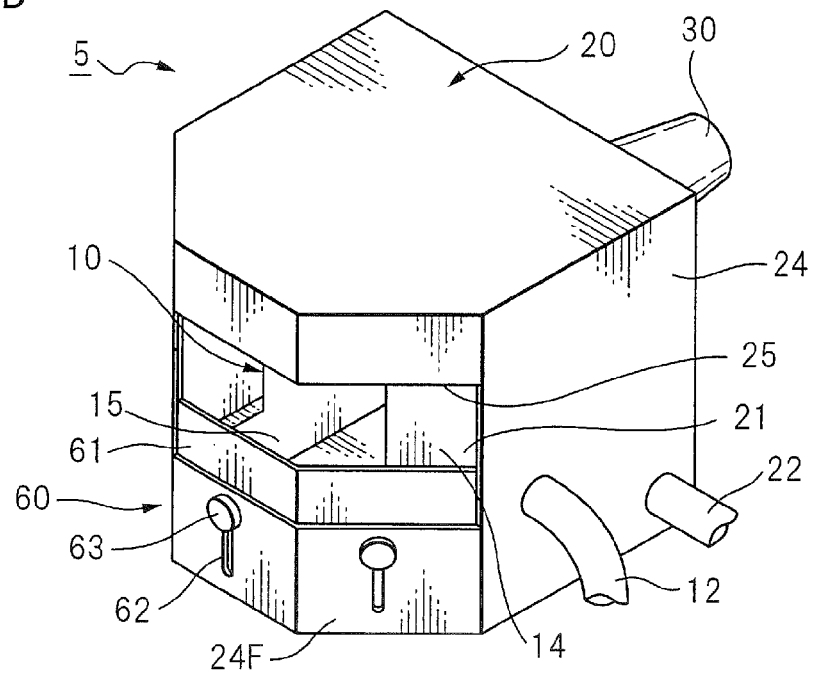
FIG. 7B is a perspective view which shows an operation of a slide plate of the second booth which is shown in FIG. 7A.

FIG. 7B shows the state where the slide plate 61 which is shown in FIG. 7A moves in the upward direction by operation of the operating knobs 63 and the distance in the height direction of the opening part 25 is shortened. In this embodiment, the shafts of the operating knobs 63 are threaded. If turned in the right direction, the operating knobs 63 are fixed to the front housing part 24F. Therefore, to change from the state which is shown in FIG. 7A to the state which is shown in FIG. 7B, the operating knobs 63 which are shown in FIG. 7A are turned in the left direction to enable the slide plate 61 to move to the front housing part 24F and the operating knobs 63 are used to make the slide plate 61 move in the upward direction. Further, when the slide plate 61 is made to move in the upward direction until the height of the opening part 25 matches the height of the metal cylindrical member to be coated, the operating knobs 63 are turned in the right direction at that position to fix the slide plate 61 at that position. The structure of the opening part height adjustment mechanism 60 is not limited to the structure of this embodiment.

Figure 7C:
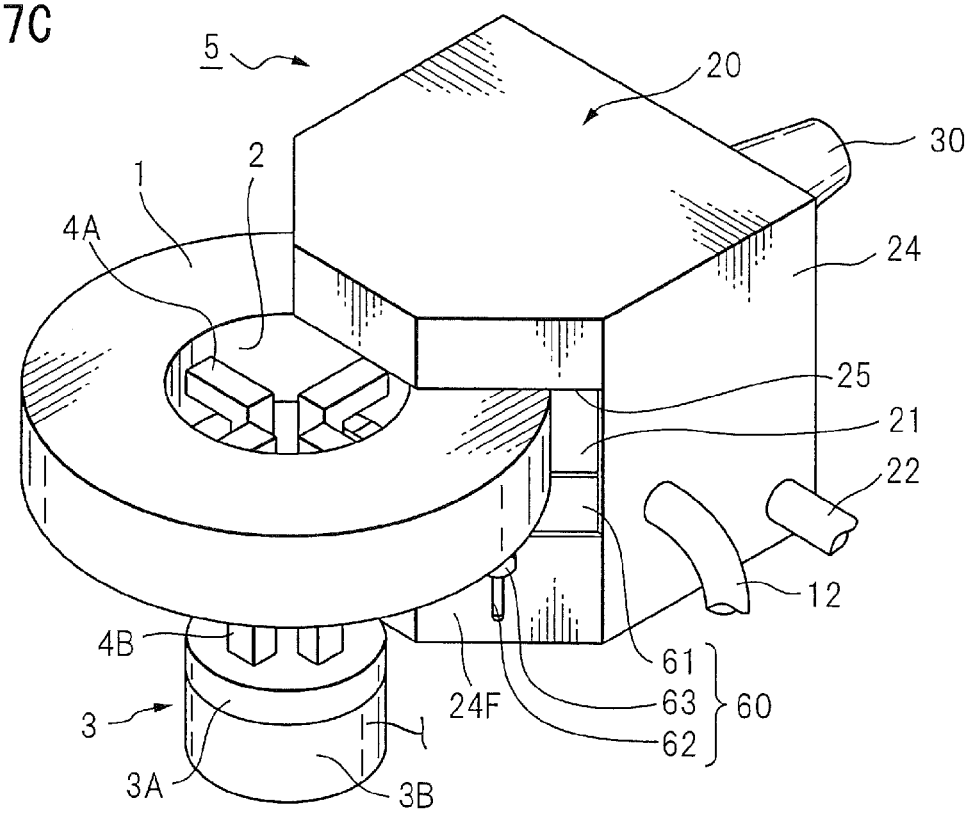
FIG. 7C is a perspective view which shows the state of the metal cylindrical member which is held by the rotating stage inserted in the second booth in the state which is shown in FIG. 7B.

FIG. 7C shows the state where part of the metal cylindrical member 1 with an internal circumferential surface 2 which is held by the arm parts 4A of the chuck member 4 of the rotating stage 3 is inserted into the opening part 25 at the second booth 20. The metal cylindrical member 1 is low in height in the axial direction. If this metal cylindrical member 1 is inserted into the opening part 25 of the second booth 20 of the first aspect, a large clearance is formed between the opening part 25 and the metal cylindrical member 1. The powder coating ends up scattering from this clearance to the outside of the second booth 20 at the time of powder coating.

On the other hand, in the powder coating system 5 of the second aspect, the slide plate 61 of the opening part height adjustment mechanism 60 can be pulled up to adjust the distance in the height direction between the metal cylindrical member 1 and the opening part 25 to 2 mm to 20 mm at both the upper side and lower side of the metal cylindrical member 1. As a result, in the powder coating system 5 of the second aspect, even if making the height of the metal cylindrical member 1 in the axial direction low, the powder coating which is used for the powder coating can be prevented from passing through the second booth 20 and scattering to the surroundings of the powder coating system 5. Accordingly, the powder coating system 5 of the second aspect can coat powder on various types of metal cylindrical members 1 with different heights in the axial direction in a state preventing powder coating from scattering to the surroundings at the time of powder coating.

In the above explained embodiment, a coatable member constituted by the metal cylindrical member 1 was illustrated and a power coating system which coated this metal cylindrical member 1 with powder was explained. However, the invention is not limited to a coatable member constituted by a metal cylindrical member. It may be any tubular member not requiring coating of the internal circumferential surface which is held by the chuck member. Further, the shape of the tube need not be cylindrical and may also be a square shaped tube or polygonal shaped tube.

The invention claimed is:

1. A powder coating system for a metal cylindrical member comprising:

a rotating stage configured to rotate said metal cylindrical member in an upright vertical position, said rotating stage holds said metal cylindrical member in an upright vertical position by engaging an internal circumferential surface of said metal cylindrical member, a first booth which covers part of the metal cylindrical member which is held by the rotating stage, a second booth which encloses the first booth, said second booth is separated by a predetermined internal space from the first booth and said second booth surrounds a same part of the metal cylindrical member which is also surrounded by said first booth, said first booth has a first opening and said second booth has a second opening, said second opening overlaps said first opening such that said second opening is configured to enclose a first portion of said metal cylindrical member when said first portion of said metal cylindrical member is inserted into said first opening of said first booth, while said metal cylindrical member is inserted into said first opening and said second opening a second portion of said metal cylindrical is located outside said first booth and said second booth, said metal cylindrical member is configured to rotate while inserted in the first opening and said second opening, a powder coating introduction nozzle configured to spray a powder coating, said powder coating introduction nozzle is provided with a single powder coating filling port and a plurality of powder coating spray ports, wherein the single powder coating filling port is positioned at an outside of the second booth, and the plurality of spray ports are provided with powder coating introduction nozzles which are adjustable in position in the first booth to face a surface part of the metal cylindrical member, and said second booth has a powder collector provided with a hose which sucks up said powder coating sprayed by said powder introduction nozzles which is remaining inside the second booth.

2. The powder coating system according to claim 1, wherein said first booth has a blow device which is provided with a pipe connected to a flow of air, said blow device is charged inside of the booth.

3. The powder coating system according to claim 2, wherein a plasma treatment device configured to use plasma to heat said metal cylindrical member is provided at a position of said metal cylindrical member which is held at said rotating stage and said plasma treatment device does not interfere with said second booth.

4. The powder coating system according to claim 3, wherein said powder coating system is provided with a controller, and said controller is configured to operate said plasma treatment device, then said controller is configured to control said powder coating introduction nozzle to spray said powder coating to coat the surface part of said metal cylindrical member.

5. The powder coating system according to claim 4, wherein controller is configured to operate said powder collector when coating the surface part of said metal cylindrical member, and then operate said blow device operate after said metal cylindrical member finishes being coated and said metal cylindrical member is detached from said rotating stage.

6. The powder coating system according to claim 1, wherein said rotating stage holds the internal circumferential surface of said metal cylindrical member by a conductive chuck member which extends and contracts in a direction of the internal circumferential surface of said metal cylindrical member and wherein said conductive chuck member is grounded.

7. The powder coating system according to claim 4, wherein said controller operates said rotating stage rotate by 5 to 1000 rpm.

8. The powder coating system according to claim 1, wherein at least the portion of said powder coating introduction nozzle inside said first booth is formed by a flexible material and wherein the positions of said plurality of powder coating spray ports can be changed to match the shape of said metal cylindrical member which is inserted into said first booth.

9. The powder coating system according to claim 1, wherein, to enable acceptance of said metal cylindrical member, an opening part which is provided at said second booth is further provided with an opening part height adjustment mechanism which can change a distance in the height direction of the opening part, said opening part height adjustment mechanism is provided with a slide plate, a guide groove, and an operating knob, said slide plate is formed to move up and down along an inside of a front housing part which is positioned below said opening part of said second booth and to change the height of said opening part, said guide groove is provided at said front housing part and restricts the distance of movement of said slide plate in the up and down direction, said operating knob is provided with a threaded shaft, said shaft being passed through said guide groove and attached to said slide plate and engaging with said front housing part by being turned to the right and being freed from said front housing part by being turned to the left, and said slide plate is made to move to match with the height of said metal cylindrical member which is inserted into said opening part, whereby the clearance between said metal cylindrical member and said opening part can be adjusted to 2 to 20 mm at the upper side and lower side of said metal cylindrical member.

* * * * *